US006951531B2

(12) United States Patent
Landen

(10) Patent No.: US 6,951,531 B2
(45) Date of Patent: Oct. 4, 2005

(54) DEVICE AND METHOD FOR EMBOSSING BOOK COVERS

(76) Inventor: Franz-Josef Landen, Sonnenbergstrasse 11, 70184 Stuttgart (DE)

( * ) Notice: Subject to any disclaimer, the term of this patent is extended or adjusted under 35 U.S.C. 154(b) by 0 days.

(21) Appl. No.: 10/311,718

(22) PCT Filed: Jun. 19, 2001

(86) PCT No.: PCT/EP01/06869

§ 371 (c)(1),
(2), (4) Date: Dec. 19, 2002

(87) PCT Pub. No.: WO01/98088

PCT Pub. Date: Dec. 27, 2001

(65) Prior Publication Data

US 2004/0011170 A1 Jan. 22, 2004

(30) Foreign Application Priority Data

Jun. 21, 2000 (DE) ..... 100 29 500

(51) Int. Cl.[7] ..... B31B 1/22
(52) U.S. Cl. ..... 493/229; 493/232
(58) Field of Search ..... 493/229, 232, 493/475, 478, 479; 270/58.07, 58.08

(56) References Cited

U.S. PATENT DOCUMENTS 1,697,326 A 1/1929 Keine
4,200,032 A * 4/1980 Roda ..... 493/451
4,231,466 A * 11/1980 Rathert ..... 198/803.7
4,820,251 A * 4/1989 Blaser ..... 493/1
5,383,755 A * 1/1995 Hassig et al. ..... 412/16
6,142,721 A * 11/2000 Marsh ..... 412/1
6,168,363 B1 * 1/2001 Nehring ..... 412/30
6,409,447 B2 * 6/2002 Malmros ..... 412/40
6,460,843 B1 * 10/2002 Dim et al. ..... 270/58.07
6,550,757 B2 * 4/2003 Sesek ..... 270/58.09
6,692,208 B1 * 2/2004 Watkiss et al. ..... 412/1
6,718,856 B2 * 4/2004 De Dompierre et al. ..... 83/103

* cited by examiner

*Primary Examiner*—Eugene Kim
(74) *Attorney, Agent, or Firm*—Collard & Roe, P.C.

(57) ABSTRACT

The invention relates to a method for notching covers (3) for a book body (2), whereby at least two notches (5, 6) which delimit the spine are made in the cover by means of a notching tool. The invention provides that a set of automatic book body pincers (50) with at least one moveable stopping face (52) is used for adjusting the distance (d) between the notches, and the value for the thickness of the book body (2), said value being determined by means of the automatic set of book body pincers (50), is used for automatically adjusting the distance (d) between the notches (5, 6). The invention also relates to a device for notching book covers (3), which comprises a notching iron (10) with a stationary and a displaceable tool pair (11, 12; 13, 14), whereby the displaceable tool pair (11, 12 or 13, 14) can be automatically adjusted by means of a control unit to the desired distance (d) between the notches (5, 6) that delimit the spine (8).

7 Claims, 3 Drawing Sheets

DEVICE AND METHOD FOR EMBOSSING BOOK COVERS

CROSS REFERENCE TO RELATED APPLICATIONS

Applicant claims priority under 35 U.S.C. §119 of German Application No. 100 29 500.2 filed Jun. 21, 2000. Applicant also claims priority under 35 U.S.C. §365 of PCT/EP01/06869 filed Jun. 19, 2001. The international application under PCT article 21(2) was not published in English.

The present invention relates to a method for notching book covers as defined in the introductory part of claim 1, as well as to a device for carrying out said method as defined in the introductory part of claim 5.

In the manufacture of books, a distinction is made between a number of manufacturing methods. In connection with the method for producing soft-cover or pocket books, a through-extending cover, which, as a rule, is made of cardboard, is used for the front and sides of the block of the book. In the manufacture of such books, this cover is glued on the spine of the book to the spine of the book. In many cases, the pages are glued on over a width of from about 3 to 5 mm as well. So that the cover and thus also the book can be opened in a better way, a notch is produced both directly following the area where the pages are glued on, and above the area where the pages are glued on.

By producing a notch, the structure of the paper is altered in the area where the notch is located. The fibers of the paper or of the composite are compressed. This change causes a reduction of the rebound forces, i.e. the cover can be opened or bent easier in that location without causing the material to break.

Various methods are known for producing notches. In the rotative production of a notch, which is the method most widely used at the present time, the cover is passed through a between a pair of rollers that is comprised of a top die and a bottom die (the matrix and the punch). The problem arising in this connection is the lack of tracking, i.e. the notch or groove may migrate away sideways. Another problem consists in that the material of the cover is milled by the rotational motion. It can be seen under the microscope that the edge breaks in particular in connection with coated surfaces.

Another method is to produce a notch by means of a notching iron. In this process, the cover is uniformly loaded and thus upset by means of a slight lifting motion. This method supplies high-grade results in terms of quality because the notches can be produced in a particularly clean manner. The cleaner the notch is produced, the higher will be the quality of the appearance of the bound book.

Both methods are applied both by hand and machines. In each case, the distance between the notches that delimit the spine of the book has to be adjusted by hand.

A standard cover is provided with four notches, as a rule. The two notches "b" and "c" delimit the spine of the book and are disposed between the surface where the glue for the spine of the book is applied, and the surfaces on which the glue for the pages is applied. Along the other side of each page gluing, another notch "a" and, respectively, "d" can be produced. The distance between the notches "a" and "b" is equal to the spacing between the notches "c" and "d". As a rule, this spacing amounts to about 5 mm. The spacing between the notches "b" and "c" is variable and depends on the thickness of the block of the book.

When the notches are produced by means of a notching iron, this processing operation has to be carried out twice in the prior art. In the first step of this processing operation, the notch lines "a" and "b" are produced by means of a so-called "twin iron". In the second step of this operation, the notch lines "c" and "d" are produced accordingly.

In each case, it has been necessary until now to adjust the spacing between the notches "b" and "c" by hand, or, if a notching iron is used, by manually adjusting the stop means for the cover in the machine. However, because of the tool set-up time, which requires much expenditure, this method is uneconomical and is therefore employed only in rare instances. Furthermore, the manual adjustment of the distance between the notches "b" and "c" carries the risk of reading errors, which then leads to inaccuracies.

In the production of soft-cover books, furthermore, the block of the book has been loaded in the set of book block pincers until now by hand, or via an automatic applicator in such a manner that the lower edge, to which the cover is glued later, is abutting smoothly. Uniform edges are required for a later uniform film of glue. The opening or width of the set of book block pincers depends on the thickness of the block of the book. In connection with the methods and machines known at the present time, the set of book block pincers has to be adjusted by hand, and in most cases with the help of tools, in a manner consuming time. This is partly accomplished by adding spacing washers. This requires a certain expenditure in terms of time in particular in view of the fact that, for example automatic single-pincer machines are mainly employed for small editions with different block thickness values, and primarily for the so-called "on demand" production. This finally means that the book block pincers have to be manually adapted in each case to the thickness of the block to be processed.

Therefore, the problem of the present invention is to provide a device and a method of the type specified above that permit an exact and clean production of notches in covers without costly setting-up times.

The solution consists in a method with the features of claim 1, and a device with the features of claim 5. Therefore, provision is made according to the invention that for adjusting the spacing between the notches, an automatic set of book block pincers with at least one movable stop face is used, and the value of the thickness of the book block that has been determined by means of the automatic set of book block pincers, is used for automatically adjusting the distance between the notches.

The device as defined by the invention is characterized in that it comprises a notching iron with a stationary pair of dies and a displaceable pair of dies, whereby the displaceable pair of dies can be automatically adjusted by means of a control unit to the desired spacing between the notches delimiting the block of the book.

It is assured in this way that the value of the thickness of the block of the book, once it has been determined by means of the set of book block pincers, is exactly transmitted to the notching tool, and applied there to the spacing between the notches delimiting the spine of the book. The method as defined by the invention and the device as defined by the invention are user-friendly; permit a high degree of automation and a higher capacity; and thus a higher through-put of covers. Double notches can be produced in one single processing pass by means of a notching iron.

The method as defined by the invention and the device as defined by the invention are preferably suited for application in book production lines.

Advantageous further developments of the invention are specified in the dependent claims.

The value determined for the thickness of the block of the book can be transmitted to a control device for controlling the notching die. The device as defined by the invention can be operated therefore as an "inline" device that contains the digital value for the thickness of the spine of the book received from a processing station installed upstream that contains the book block pincers. However, the device as defined by the invention can be operated also as a "stand-alone" device, in connection with which the values of the thickness of the spine of the book are input, for example via a keyboard. The device operating as defined by the invention, which is preferably a binding machine with from one to five sets of pincers, thus can be provided with a set of book block pincers that no longer need to be adjusted to the different thickness values of the block. This measure represents an important contribution to automation in the area of small machines and reduces the machine set-up times enormously. Another important aspect is the fact that no tool is required in this connection.

The value for the thickness of the block of the book is preferably determined by first opening the set of pincers for the block of the book to a maximal value and by then closing the set of pincers for receiving a book block, whereby in the course of the opening and closing process, the time required for the opening and the closing operations is measured and stored in a control unit; the difference between the two values is computed and stored; and the stored value is digitally transmitted to the control device for controlling the notching die. In this connection, a value corresponding with the volume of the paper in the book blocks to be received having the largest volume can be added to the value determined for the difference, in order to avoid errors conditioned by different paper volumes.

The set of book block pincers (50) may comprise a stationary stop face (51) and a movable stop face (52), which are connected with one another via at least two axles (53, 54), whereby the movable stop face (52) can be displaced along the axles (53, 54). On the ends of the axles (53, 54) associated with the movable stop face, provision can be made for toothed racks that are actively connected with a pinion, so that the movable stop face (52) can be displaced by the actuation of the pinion. The pinion may be actuated by means of an electric motor.

An exemplified embodiment of the present invention is explained in greater detail in the following with the help of the attached drawings, in which.

Figure 4:
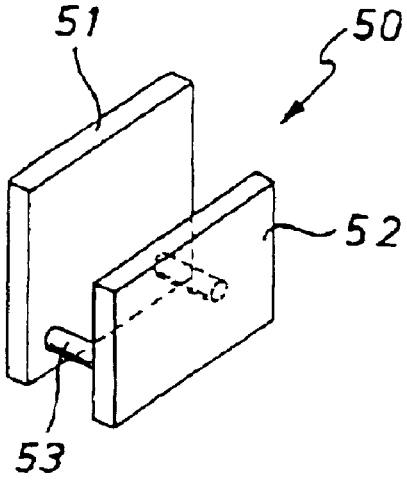
FIG. 4 is a schematic, not true-to-scale perspective representation of an exemplified embodiment of an automatic set of book block pincers.
Figure 5A:
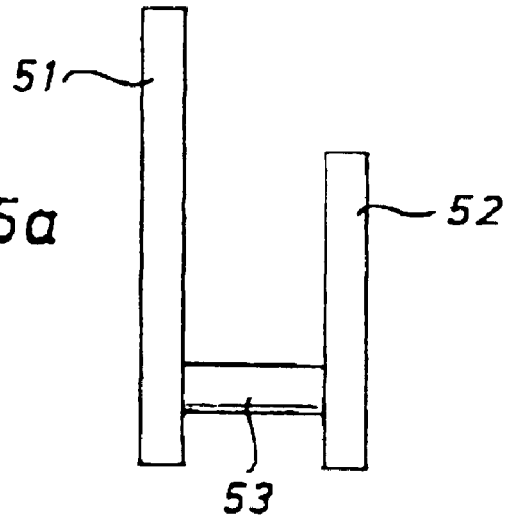
Figure 5B:
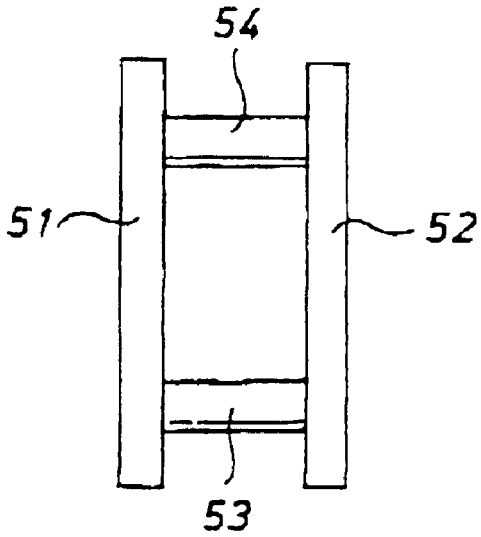

FIG. 5*a* shows a side view of the set of book block pincers from FIG. 4; and FIG. 5*b* is a view of the set of book block pincers of FIG. 4 from the bottom.

Figure 1:
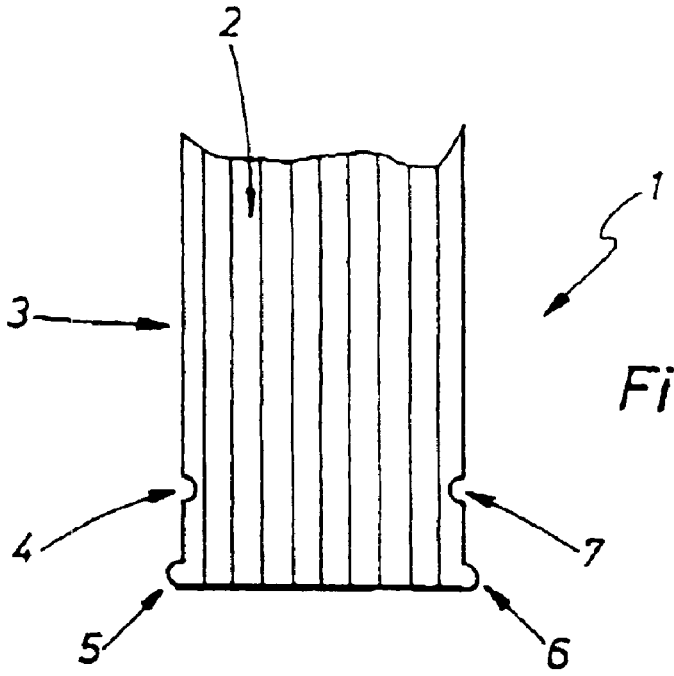
FIG. 1 is a schematic, not true-to-scale representation of a bound book with a cardboard cover with four notches.
Figure 2:
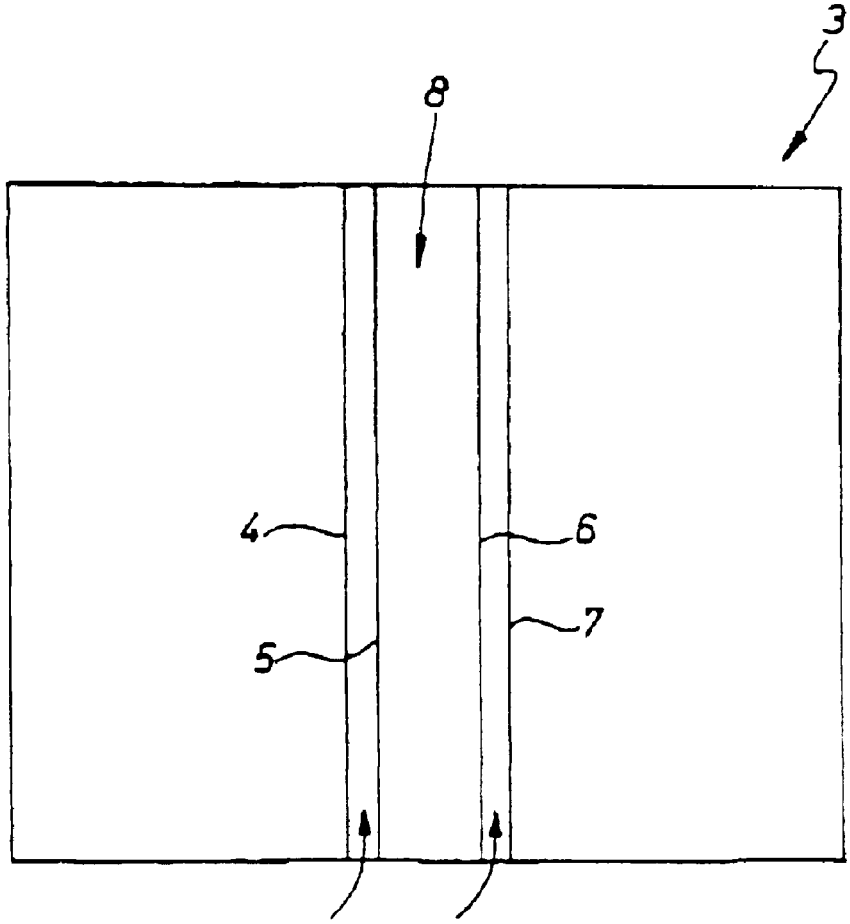
FIG. 2 shows the cover of FIG. 1 by a representation showing the book folded open.

FIGS. 1 and 2 show the typical positioning of four notches in a cardboard cover. The bound book 1 is comprised of a book block 2 and a cardboard cover 3. The cover 3 has the notches 4, 5, 6, 7. The distance between the notches 4 and 5 is equal to the distance between the notches 6 and 7 and amounts to about 5 mm, as a rule. The surface between the notches 4 and 5 and 6 and 7, respectively, is glued to the pages of the book block, so that the so-called page gluing is the result. Each pair of notches 4,5 and 5,6 thus can be referred to also as a double notch, whereby the outer notches 4 and 7 are pointing inwards in the direction of the book block 2, and the inner notches 5, 6 are pointing outwards away from the book block 2.

The notches 5 and 6 delimit the book spine 8, i.e. the part of the cover 3 that later covers the spine of the book block 2. The book spine 8 is glued to the spine of the book block 2. The spacing between the notches 5 and 6 is therefore variable and dependent on the thickness of the book block 2.

Figure 3:
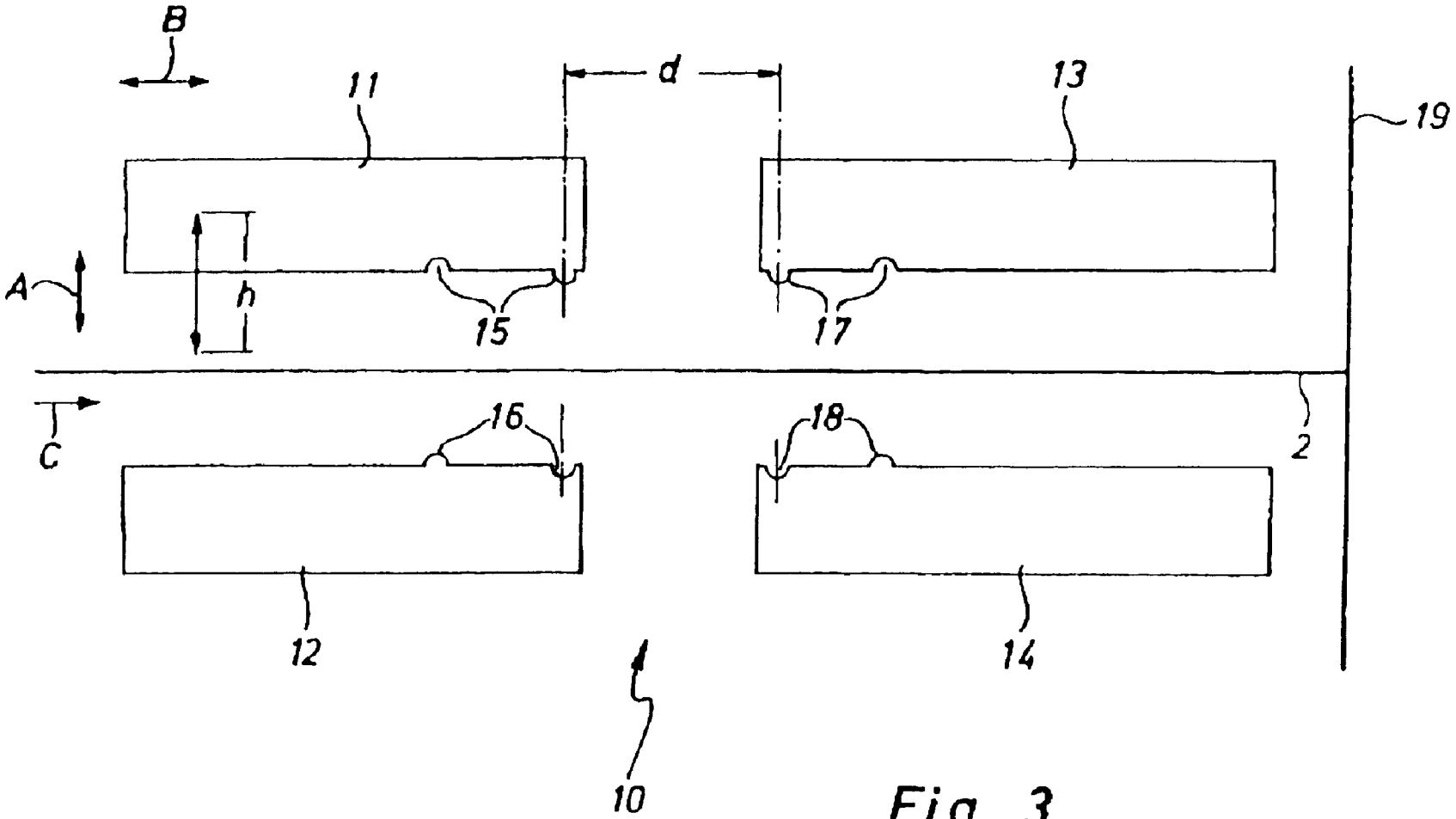
FIG. 3 is a schematic representation of a notching die.

FIG. 3 shows a device for carrying out the method as defined by the invention, namely a notching iron 10. The notching iron 10 is comprised of the two top dies 11, 13 and the two bottom dies 12, 14. The dies 11, 12 and 13, 14 form in each case a pair consisting of a matrix and a punch and have a device 15, 16, 17, 18 for producing a double notch 4,5 and 6, 7, respectively. The two top dies 11 and 13 perform a synchronous lifting movement along the arrow A in FIG. 3. The height "h" of the lifting movement is preferably dimensioned in such a way that that normal cover weights can be processed, i.e. from 170 to 300 g/m$^3$. The measure of said height "h" is preferably just adequate for easily loading the cover 3 in the dies. The height "h" is preferably fixed and needs not to be adjusted separately by the operator of the notching iron 10.

The spacing between the two pairs of dies (11, 12 and 13, 14) has to be adjusted depending on the thickness of the book block 2, so that the resulting notches 5 and 6 have the desired spacing conforming to the thickness of the book block 2. This adjustment is made automatically via a control. The desired spacing is received from a preceding processing step, in which the book block 2 is retained by an automatically controlled set of book block pincers 50, by which the spine of the book block 2 is processed, for example by roughening it. This value either can be read and separately input in the device as defined by the invention, for example by entering it via a keyboard ("stand-alone" device), or it can be transmitted directly by the control of the set of book block pincers to the control of the notching iron 10 ("in-line" device).

The notching iron is designed in such a way that one pair of dies 11, 12, or 13, 14 is stationary, and the other pair can be infinitely displaced along the arrow B in FIG. 3, for example by means of a servo-motor. The pair 13, 14, for example, is stationary, and the pair 11, 12 is displaceable.

The cover 2 is automatically supplied to the device as defined by the invention in the manner known per se, for example via an inclined belt in a defined feeding direction along the arrow C in, and pulled into the device. It is positioned along a defined stop or alignment edge 18. This edge may be an electrically, pneumatically or hydraulically movable stopper edge in order to process, for example differently sized covers. The pair of dies 11, 12 is then automatically displaced in such a manner that the spacing "d" will correspond with the thickness of the book block 2. The two double notches 4, 5 and 6, 7 are then produced in the cover 2.

Of course, the stationary pair of dies and the movable pair of dies may be arranged in the reversed manner as well, i.e. in FIG. 3, for example, the pair 11, 12 is stationary and the pair 13, 14 is movable, with the same feeding direction along the arrow C.

The method as defined by the invention and the device as defined by the invention are naturally suited for producing two single notches 5, 6 as well.

The device operating according to the method as defined by the invention is preferably equipped with an automatic set of the book block pincers 50. An exemplified embodiment of these book block pincers 50 as shown in FIGS. 6, 7*a* and 7*b* is comprised of a stationary rear stop face 51 and a smaller movable front face 52, or pressing plate, which are connected with each other via at least the two axles 53, 54. The dimensions of the overall set of book block pincers are selected in such a way that all commonly used book formats ranging from DIN A6 to DIN A3 can be processed. This applies as well to the block thickness in the range of from at least about 3 mm to about 60 mm at the most.

The front stop face 52 can be driven on the axles 53, 54 by a correspondingly suitable bearing guide (not shown). Pinions are secured on each of the two ends of the axles 53, 54. Via a pinion that is connected with a through-extending axles, the front stop face 52 is motor-driven forwards, i.e. for the opening process, and rearwards, i.e. for the closing process. The movements of the pinion are incrementally counted and stored in a control unit. Thus a book block is loaded after the set of bock block pincers 50 has been opened for the first time to the greatest possible width, for example to 60 mm. The front stop face 52 is driven inwards in the direction of the rear stop face 51, so that the book block is compressed. The difference of the "displacement distance" so obtained versus the entire opening distance of the opening path corresponds with the thickness of the book block. This value is stored. If the same type of book blocks is processed subsequently, the set of book block pincers 50 is opened only to the opening width so determined and stored. It is no longer necessary to adjust the opening width by hand.

The thickness of the book block can be measured also over the time that is elapsing until the front stop face 52, which is driven at a constant speed, has been driven inwards to such an extent that it comes to a standstill on the book block.

This acquired value is transmitted also to a servo-motor that opens or closes the glue jet accordingly, so that a strip of glue corresponding with the required width conforming to the thickness of the book block is applied. Furthermore, said acquired value is transmitted to another servo-motor that opens or closes the spacing between two or more notching dies accordingly. This is required for the preparation of the cover.

In practical applications, paper may have different volumes, i.e. some papers appear to be softer and can be pressed that much more. This phenomenon is taken into account in that an amount of, for example five or ten millimeters is added to the stored value. In this way, it is assured that all papers including even those with different volumes can be processed without problems.

The difference in the displacement distance described above, plus the pressing distance mentioned above is forming the value stored. This distance, and thus the required opening of the set of pincers is adjusted automatically, without any tool or some other manipulation. The value remains stored until the entire edition with this format has been processed, i.e. the set of pincers will open only to the extent determined by the value. In order to change again the opening of the set of pincers, it is necessary only to erase the stored value.

What is claimed is:

1. A method for embossing covers (3) for a book block (2), whereby at least two grooves (5, 6) delimiting the spine of the book are produced in the cover by means of an embossing die, comprising for adjusting the spacing between the grooves, using an automatic set of book block pincers (50) comprising at least one movable stop face (52); and using the value of the thickness of the book block (2) determined by means of the automatic set of book block pincers (50) for automatically adjusting the spacing (d) between the grooves (5, 6); and wherein the set of book block pincers (50) is first opened to the maximum value and subsequently closed for receiving a book block (2), whereby in the course of the opening and closing process, the movement of the at least one movable stop face (52) or the required time is measured by and stored in a control unit, and the difference between the two values is computed and stored and the stored value is digitally transmitted to the control device for the embossing die (10).

2. The method according to claim 1, wherein the value determined for the thickness of the book block (2) is transmitted to a control device for the embossing die (10).

3. The method according to claim 1, wherein a value is added to the value determined for the difference, said added value corresponding with the volume of the paper with the largest volume contained in the book blocks to be received.

4. A device for embossing covers (3), comprising an embossing iron (10) with one stationary and one displaceable set of dies (11, 12; 13, 14), whereby by means of a control unit, the displaceable set of dies (11, 12; or 13, 14) can be automatically adjusted to the desired spacing (d) between the grooves (5,) delimiting the spine (8) of the books;

wherein it comprises, furthermore, an automatic set of book block pincers (50) with at least one movable stop face (52); and wherein the set of book block pincers (50) comprises a stationary stop face (51) and a movable stop face (52) connected with one another via at least two axles (53, 54), whereby the movable stop face (52) can be displaced along the axles (53, 54).

5. The device according to claim 4, wherein it comprises a device for inputting the values for the thickness of the book block (2).

6. The device according to claim 4, wherein provision is made on the ends of the axles (53, 54) associated with the movable stop face for toothed racks actively connected with a pinion, so that the movable stop face (52) can be displaced by the actuation of the pinion.

7. The device according to claim 4, wherein the pincers can be actuated by means of an electric motor.

* * * * *